US007243700B2

(12) United States Patent
Beals et al.

(10) Patent No.: US 7,243,700 B2
(45) Date of Patent: Jul. 17, 2007

(54) METHOD FOR CASTING CORE REMOVAL

(75) Inventors: James T. Beals, West Hartford, CT (US); Gary M. Lomasney, Glastonbury, CT (US); Joseph J. Parkos, Jr., East Haddam, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/261,164

(22) Filed: Oct. 27, 2005

(65) Prior Publication Data

US 2007/0095501 A1 May 3, 2007

(51) Int. Cl.
*B22D 29/00* (2006.01)

(52) U.S. Cl. ..... 164/132; 164/345; 134/2; 134/166 R

(58) Field of Classification Search ..... 164/132, 164/345; 134/2, 166 R
See application file for complete search history.

(56) References Cited

U.S. PATENT DOCUMENTS

| | | | | |
|---|---|---|---|---|
| 4,141,781 | A | 2/1979 | Greskovich et al. | |
| 4,287,932 | A * | 9/1981 | Schneider | 164/516 |
| 4,440,729 | A * | 4/1984 | Jonsson | 216/93 |
| 5,822,853 | A * | 10/1998 | Ritter et al. | 29/890.01 |
| 5,915,452 | A * | 6/1999 | Conroy et al. | 164/345 |
| 6,241,000 | B1 | 6/2001 | Conroy et al. | |
| 6,637,500 | B2 * | 10/2003 | Shah et al. | 164/369 |
| 6,739,380 | B2 | 5/2004 | Schlienger et al. | |

* cited by examiner

*Primary Examiner*—Kevin Kerns
*Assistant Examiner*—I.-H. Lin
(74) *Attorney, Agent, or Firm*—Bachman & LaPointe, P.C.

(57) ABSTRACT

To destructively remove a refractory metal casting core from a cast part the part is exposed to a combination of nitric acid and sulfuric acid.

6 Claims, 2 Drawing Sheets

METHOD FOR CASTING CORE REMOVAL

BACKGROUND OF THE INVENTION

The invention relates to investment casting. More particularly, the invention relates to the removal of metallic casting cores from cast parts.

Investment casting is commonly used in the aerospace industry. Various examples involve the casting of gas turbine engine parts. Exemplary parts include various blades, vanes, seals, and combustor panels. Many such parts are cast with cooling passageways. The passageways may be formed using sacrificial casting cores.

Exemplary cores include ceramic cores, refractory metal cores (RMCs), and combinations thereof. In exemplary combinations, the ceramic cores may form feed passageways whereas the RMCs may form cooling passageways extending from the feed passageways through walls of the associated part.

After the initial casting of the part (e.g., from a nickel- or cobalt-based superalloy), the casting shell and core(s) are destructively removed. Exemplary shell removal is principally mechanical. Exemplary core removal is principally chemical. For example, the cores may be removed by chemical leaching. Exemplary leaching involves use of an alkaline solution in an autoclave. Exemplary leaching techniques are disclosed in U.S. Pat. Nos. 4,141,781, 6,241,000, and 6,739,380.

Especially where long and/or fine passageways are concerned, the leaching may be quite time-consuming. Problems faced in leaching include: minimizing adverse effects on the cast part; and effective leaching of both metallic and ceramic cores where a combination is used.

SUMMARY OF THE INVENTION

One aspect of the invention involves a combination of nitric acid and sulfuric acid used to destructively remove at least one casting core (e.g., a refractory metal casting core) from a cast part.

Another aspect of the invention involves a combination of an alkaline leaching and an acid leaching to remove at least one casting core (e.g., a combination of ceramic and refractory metal casting cores) from a cast part.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
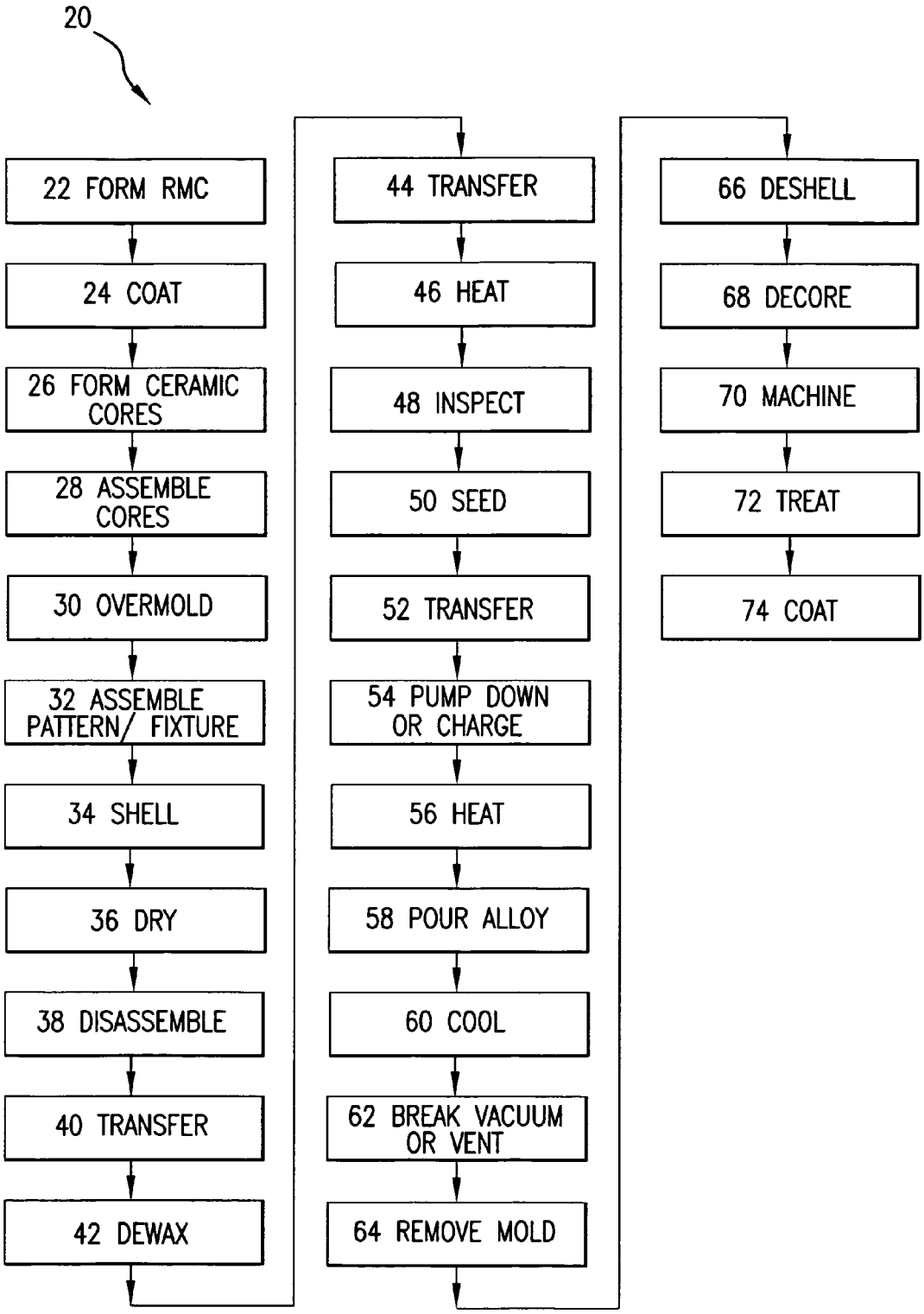
FIG. 1 is a flowchart of an investment casting process.

FIG. 1 shows an exemplary method 20 for forming an investment casting mold. Other methods are possible, including a variety of prior art methods and yet-developed methods. One or more metallic core elements are formed 22 (e.g., of refractory metals such as molybdenum and niobium by stamping or otherwise cutting from sheet metal) and coated 24. Suitable coating materials include silica, alumina, zirconia, chromia, mullite and hafnia. Preferably, the coefficient of thermal expansion (CTE) of the refractory metal and the coating are similar. Coatings may be applied by any appropriate line-of sight or non-line-of sight technique (e.g., chemical or physical vapor deposition (CVD, PVD) methods, plasma spray methods, electrophoresis, and sol gel methods). Individual layers may typically be 0.1 to 1 mil thick. Layers of Pt, other noble metals, Cr, Si, W, and/or Al, or other non-metallic materials may be applied to the metallic core elements for oxidation protection in combination with a ceramic coating for protection from molten metal erosion and dissolution.

One or more ceramic cores may also be formed 26 (e.g., of or containing silica in a molding and firing process). One or more of the coated metallic core elements (hereafter refractory metal cores (RMCs)) are assembled 28 to one or more of the ceramic cores. The core assembly is then overmolded 30 with an easily sacrificed material such as a natural or synthetic wax (e.g., via placing the assembly in a mold and molding the wax around it). There may be multiple such assemblies involved in a given mold.

The overmolded core assembly (or group of assemblies) forms a casting pattern with an exterior shape largely corresponding to the exterior shape of the part to be cast. The pattern may then be assembled 32 to a shelling fixture (e.g., via wax welding between end plates of the fixture). The pattern may then be shelled 34 (e.g., via one or more stages of slurry dipping, slurry spraying, or the like). After the shell is built up, it may be dried 36. The drying provides the shell with at least sufficient strength or other physical integrity properties to permit subsequent processing. For example, the shell containing the invested core assembly may be disassembled 38 fully or partially from the shelling fixture and then transferred 40 to a dewaxer (e.g., a steam autoclave). In the dewaxer, a steam dewax process 42 removes a major portion of the wax leaving the core assembly secured within the shell. The shell and core assembly will largely form the ultimate mold. However, the dewax process typically leaves a wax or byproduct hydrocarbon residue on the shell interior and core assembly.

After the dewax, the shell is transferred 44 to a furnace (e.g., containing air or other oxidizing atmosphere) in which it is heated 46 to strengthen the shell and remove any remaining wax residue (e.g., by vaporization) and/or converting hydrocarbon residue to carbon. Oxygen in the atmosphere reacts with the carbon to form carbon dioxide. Removal of the carbon is advantageous to reduce or eliminate the formation of detrimental carbides in the metal casting. Removing carbon offers the additional advantage of reducing the potential for clogging the vacuum pumps used in subsequent stages of operation.

The mold may be removed from the atmospheric furnace, allowed to cool, and inspected 48. The mold may be seeded 50 by placing a metallic seed in the mold to establish the ultimate crystal structure of a directionally solidified (DS) casting or a single-crystal (SX) casting. Nevertheless the present teachings may be applied to other DS and SX casting techniques (e.g., wherein the shell geometry defines a grain selector) or to casting of other microstructures. The mold may be transferred 52 to a casting furnace (e.g., placed atop a chill plate in the furnace). The casting furnace may be pumped down to vacuum 54 or charged with a non-oxidizing atmosphere (e.g., inert gas) to prevent oxidation of the casting alloy. The casting furnace is heated 56 to preheat the mold. This preheating serves two purposes: to further harden and strengthen the shell; and to preheat the shell for the introduction of molten alloy to prevent thermal shock and premature solidification of the alloy.

After preheating and while still under vacuum conditions, the molten alloy is poured 58 into the mold and the mold is allowed to cool to solidify 60 the alloy (e.g., after withdrawal from the furnace hot zone). After solidification, the vacuum may be broken 62 and the chilled mold removed 64 from the casting furnace. The shell may be removed in a deshelling process 66 (e.g., mechanical breaking of the shell).

The core assembly is removed in a decoring process 68 to leave a cast article (e.g., a metallic precursor of the ultimate part). Inventive multi-stage decoring processes are described below. The cast article may be machined 70, chemically and/or thermally treated 72 and coated 74 to form the ultimate part. Some or all of any machining or chemical or thermal treatment may be performed before the decoring.

The exact nature of an appropriate decoring process 68 will depend on several factors. These factors include: the particular material(s) of the RMC(s), including any coating; the particular material(s) of any ceramic core(s); the particular casting alloy; and the core geometries. The materials provide various issues of effectiveness and compatibility with various removal techniques. The geometry issues influence the accessibility and required exposures.

A first group of exemplary inventive processes involve use of an acid leaching mechanism preferentially to remove the RMC(s). For example, the acid leaching mechanism may remove a majority of the RMC(s) while leaving the ceramic core(s) essentially or largely intact. An alkaline leaching mechanism may be used to preferentially remove the ceramic core(s). More broadly, the acid leaching mechanism may remove a greater proportion of one or more first RMC(s) than of one or more other cores (e.g., different RMCs or ceramic core(s)) and may remove a majority of the first RMC(s) while only a minor portion of the other core(s). The alkaline leaching mechanism may be used to preferentially remove the other core(s).

Figure 2:
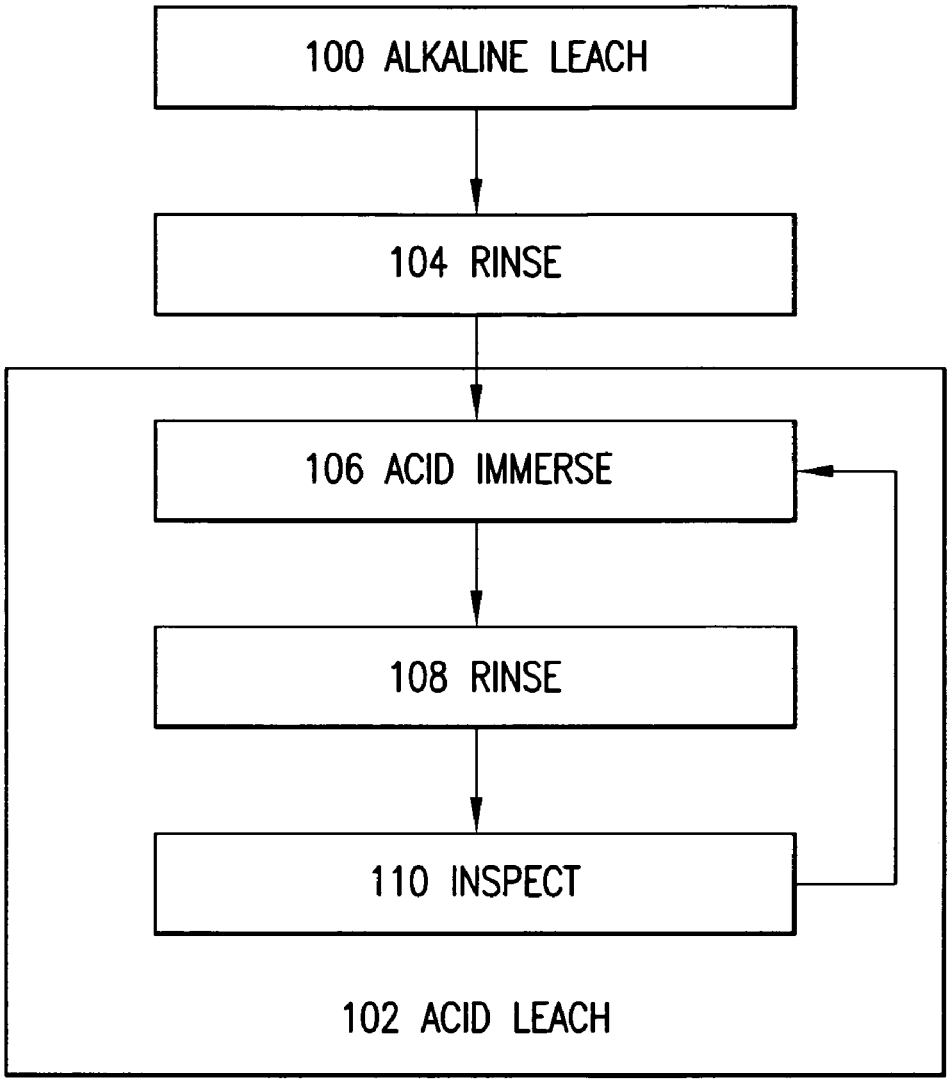
FIG. 2 is a flowchart of an exemplary decoring process within the process of FIG. 1.

FIG. 2 shows one such exemplary decoring process wherein a alkaline leaching process 100 precedes an acid leaching process 102. An exemplary alkaline process includes placing the casting in an autoclave and immersing the casting in an alkaline solution (e.g., 22.5% potassium Hydroxide). The solution exposure may be at an elevated pressure (e.g., 0.5 (75)-1.37 (200) MPa(PSI) gage) and a moderately elevated temperature (e.g., 350° F. (177° C.), more broadly 150-400° C., for an exemplary twelve hours, more broadly 1-72 hours). The pressure may be cycled and/or the solution otherwise agitated to maintain exposure of the alkaline solution to the ceramic and evacuate reaction products. There also may be intermediate rinses (e.g., with water at atmospheric pressure) to help evacuate reaction products.

After an optional cleaning rinse 104 (possibly including multiple rinse cycles with conductivity or other tests to determine rinse completion), the exemplary acid leaching process 102 includes immersing 106 the casting in an acid solution (e.g., a combination solution discussed below). The exposure may be at an elevated temperature. An exemplary temperature is lower then that of the alkaline autoclave. An exemplary temperature range is from ambient/room temperature to 120° F. (49° C.), more broadly to 80° C. The solution may be agitated to maintain exposure of the acid solution to the RMC and evacuate reaction products. Similarly, intermediate rinses 108 may aid evacuation and facilitate intermediate inspection 110.

Figure 3:
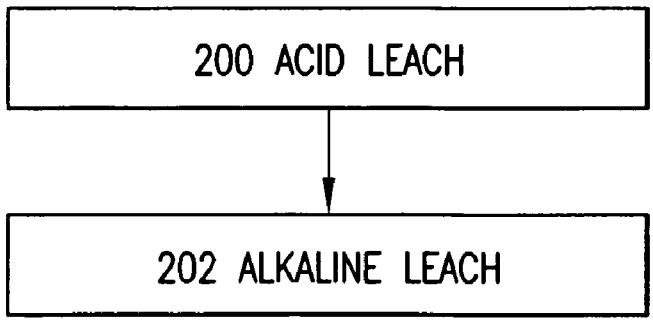
FIG. 3 is a flowchart of an alternate decoring process.

FIG. 3 shows another such exemplary decoring process wherein an acid leaching process 200 (e.g., similar to 102) precedes an alkaline leaching process 202 (e.g., similar to 100). This may be warranted where alkaline attack on the casting is sought to be minimized. Depending on core configuration, there may be a moderate increase in the time required for the acid leaching process (e.g., a doubling or slightly greater) relative to the FIG. 2 process. However, the alkaline leaching process may be reduced even more substantially (e.g., to less than a third). For example, access through outlet passageways left by an RMC may allow near instant attack by the alkaline solution along the length of a ceramic feedcore.

Experiments regarding the removal of molybdenum have indicated a number of relevant physical and chemical mechanisms for consideration in the selection of appropriate parameters of the acid leaching process. Nickel and cobalt superalloys in the cast, single crystal, and directionally solidified conditions were exposed to the combination of acids at varying temperatures from an ambient 70° F. (21° C.) to an elevated 150° F. (66° C.) for 24 hours. There were no adverse effects (<0.0005 inch material loss) on the tested alloys up to 120° F. (49° C.). Higher temperature yielded faster dissolution of the molybdenum RMC. Moderate etching of the casting was found at 150° F. (66° C.). Thus one recommended temperature for core removal without detrimental affects on the base material is near 120° F. (49° C.) (e.g., 100-140° F. (38-60° C.)).

Speed of removal from the casting is influenced by the accessibility of the RMC to the acid. Total dissolved metal also affects the dissolution rate. The rate drops rapidly when the total dissolved molybdenum exceeds 20 g/L. The solution ceases to perform satisfactorily beyond 30 g/L. Various combinations of concentrations of nitric acid and sulfuric acid were evaluated. A concentration of 50% nitric and 5% sulfuric provided advantageous results balancing speed of removal and affect on the base metal. Agitation improved the rate by delivering fresh acid to the desired area but was thus not quantified.

From these experiments, it is seen that a synergistically advantageous combination of nitric acid ($HNO_3$) and sulfuric acid ($H_2SO_4$) was discovered. An aqueous solution consisting essentially of, by volume, 40-60% nitric acid and 3-10% sulfuric acid would be expected to provide advantageous results. For this solution, by volume, the nitric acid concentration may be an exemplary 4-20 times the sulfuric acid concentration, more narrowly 8-15 times.

One or more embodiments of the present invention have been described. Nevertheless, it will be understood that various modifications may be made without departing from the spirit and scope of the invention. For example, the principles may be implemented as modifications of existing or yet-developed processes in which cases those processes would influence or dictate parameters of the implementation. Accordingly, other embodiments are within the scope of the following claims.

What is claimed is:

1. A method for removing a ceramic first casting core and a refractory metal-based second casting core from a cast part comprising:

a first leaching step for removing a major portion of the first casting core and comprising alkaline leaching and including a plurality of first intervals at a pressure of 0.5 MPa to 1.37 MPa interposed with a plurality of second intervals at ambient pressure; and a second leaching step for removing a major portion of the second casting core and comprising acid leaching, the second leaching step including:

immersing in a solution containing nitric acid and sulfuric acid; and an interval at a temperature of 38-49° C.

2. The method of claim 1 wherein:

the first leaching step comprises exposing to a temperature of at least 100° C.; and the second leaching step comprises exposing to a temperature of up to 66° C.

3. The method of claim 1 wherein:

the first leaching step comprises exposing to a temperature of at least 150° C.; and the second leaching step comprises exposing to a temperature of up to 60° C.

4. The method of claim 1 used to manufacture a gas turbine engine component.

5. The method of claim 1 wherein the cast part consists essentially of a nickel- or cobalt-based superalloy.

6. The method of claim 1 wherein the second core consists essentially of a ceramic-coated molybdenum-based substrate.

* * * * *